United States Patent [19]

Giesselmann

[11] 4,134,351

[45] Jan. 16, 1979

[54] SEWING MACHINE

[75] Inventor: Hannes Giesselmann, Huskvarna, Sweden

[73] Assignee: Husqvarna Aktiebolag, Huskvarna, Sweden

[21] Appl. No.: 810,942

[22] Filed: Jun. 29, 1977

[30] Foreign Application Priority Data

Jul. 1, 1976 [SE] Sweden ..... 7607540

[51] Int. Cl.[2] ..... D05B 3/02

[52] U.S. Cl. ..... 112/158 A; 112/158 B

[58] Field of Search ..... 112/158 A, 158 B, 158 R, 112/254

[56] References Cited

U.S. PATENT DOCUMENTS 1,167,823 1/1916 Huffman et al. ..... 112/254 X 3,033,138 5/1962 Bono ..... 112/158 B 3,075,483 1/1963 Engel ..... 112/158 B

*Primary Examiner*—Peter Nerbun

*Attorney, Agent, or Firm*—Holman & Stern

[57] ABSTRACT

In a zig-zig sewing machine an automatic adjustment is provided for obtaining the correct values for stitch-length and upper thread tension in sewing fancy seams or button holes by moving a setting knob for such seams to the required symbol. The adjustment is made independently of the existing setting established for stitch-length and thread tension by the use of a pattern selector which in addition to selecting a required pattern activates controls for cloth feed and over-thread tension by a cam and linkage system which transmits movement from the pattern selector directly to an adjustable cullis and thread brake.

6 Claims, 5 Drawing Figures

SEWING MACHINE

The present invention relates to control means in sewing machines for sewing fancy seams.

When sewing fancy seams and cyclic seams such as button-holes for example, it is often necessary to sew a sample seam on a spare piece of cloth, before commencing to sew the actual seam, the tension of the upper thread of the sewing machine, the length of stitch etc. being adjusted during the sample-sewing operation to values corresponding to a seam of the desired quality. To facilitate these adjustments, the sewing machine is normally provided with controls having symbols thereon which indicate a suitable setting of the control for the pattern of seam in question. With the majority of sewing machines, some of the controls must be re-set, which is both time consuming and troublesome, when desiring to switch between different seam patterns.

An object of the present invention is to provide for automatic adjustment to correct values, with respect to stitch-length and the tension of the upper thread, for fancy patterns or button-holes when the setting knob for these seams is rotated to the symbols intended for said seams. The adjustment is made in complete independence of the existing setting of the control for stitch-length and thread-tension. In a sewing machine having these properties there is provided, in accordance with a invention, the pattern selecting means including a setting region in which, in addition to the selection of a pattern, controls for the cloth feed and over-thread tension are arranged to be activated and set to predetermined values by means for transmitting movement from the pattern selecting means directly to an adjustable cullis and thread brake respectively, irrespective of the setting positions of respective setting means for said cullis and brake.

A sewing machine according to the invention will be described hereinafter with reference to the accompanying drawing, in which.

Figure 1:
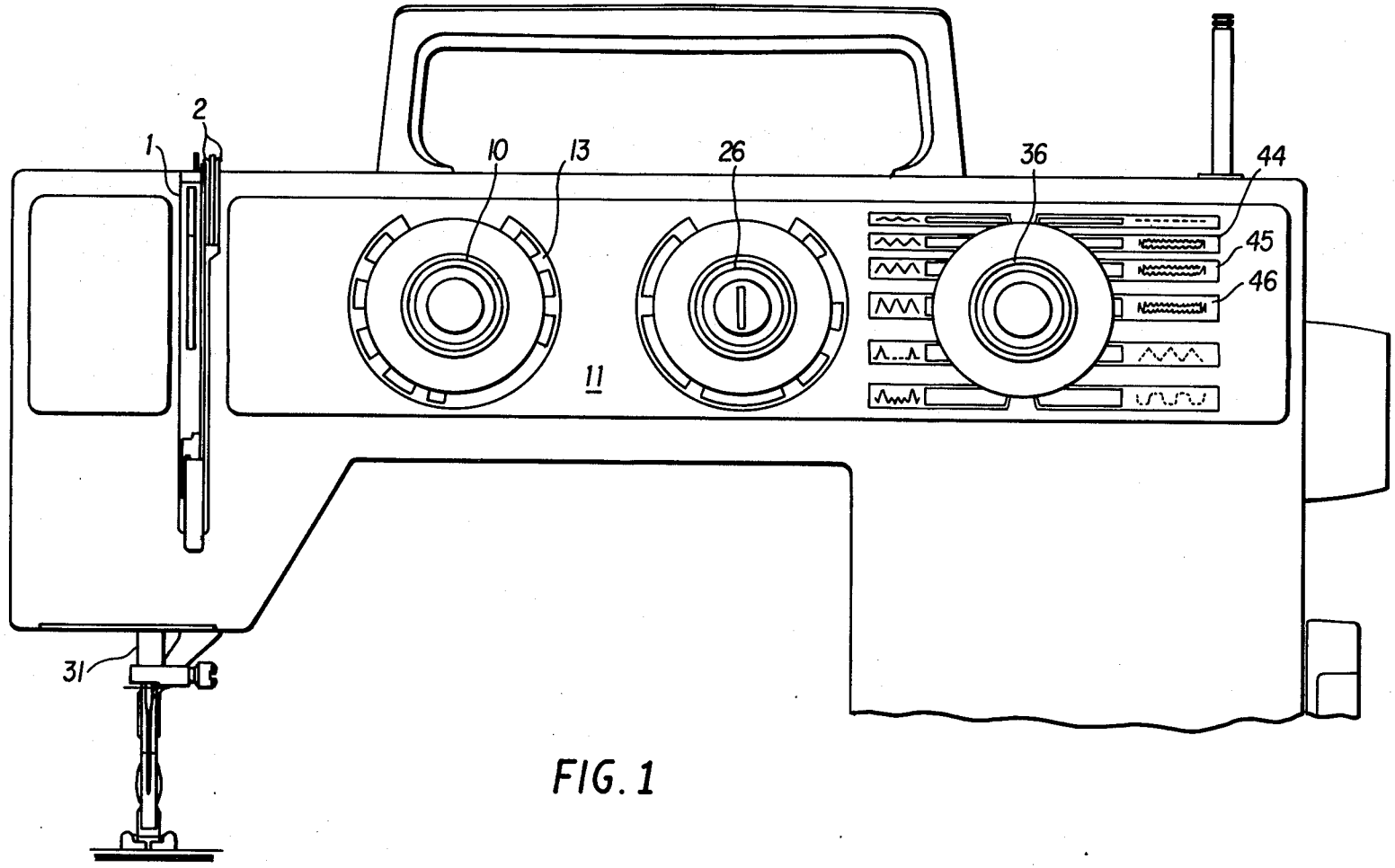
FIG. 1 is a vertical projection of the front side of the machine.

As will be evident from the following description, the illustrated machine comprises elements which are known in sewing machines of conventional constructions; thus the machine comprises press-rod guides and needle-bar guides, thread-tension mechanisms, an upper spindle unit, a stitch-length guide, a guide for zig-zag seams, underarm spindles and a shuttle mechanism. Of these main elements, the thread-tension and stitch-length mechanisms are of particular interest with respect to the control means according to the invention.

The thread-tension mechanism has a holder 1 for a thread brake comprising two plates 2 arranged on a shaft 3. The tension is produced by a press bar 4 and a coil spring 5 which urges the plates together in the holder, via an angled plate 6. The pressbar 4 has an elongate hole 7 through which a fixing and guide pin 8 extends, and a curve-follower 9. A setting knob 10 is mounted on the front side 11 of the body of the sewing machine. The inner end of the setting knob 10 has the form of a curve-spiral 12 in which the curve-follower extends. When the knob is rotated the follower slides on the curve and displaces the rod in its longitudinal direction. The spring force is influenced by the position of the rod, and the thread tension, which is determined by the pressure between the plates 2, can thus be adjusted smoothly by means of the knob 10, the position of which can be read off from a scale 13.

Arranged in the under-arm 14 is a shuttle mechanism, a feeder 15 and a stitch plate, these elements being arranged as in a conventional sewing machine. The elements are generally known and need no description. The feeder, which executes a substantially rectangular pattern of movement, has two drive members, one for horizontal movement and one for vertical movement. The horizontal movement, which is variable, is effected by means of a linkage system 16, 17, a regulatable cullis 18 and an eccentric drive means 19 on the over-arm spindle 20 of the machine, said drive means 19 causing the feed movement. The vertical movement is constant and is effected by means of a further link system 21, 22 and a further eccentric member 23 on the over-arm spindle. The drive means 19, 23 are single-acting, and the reciprocating movements are effected by means of springs 24, 25. A feeder drive mechanism of this description is known from other sewing machine constructions.

The length of stitch is set by rotating a knob 26 on the front side of the machine. The knob is provided with an internal screw thread in which a screw-peg is displaced axially when the knob is turned. The outwardly projecting end of the peg presses against a lever arm 28 having a hooked portion which engages around a shaft 29, said shaft forming the pivot axis of the cullis 18. The cullis and the lever arm are joined by means of a pin 30, whereby setting movements are transmitted from the knob to the cullis via the pin and the lever arm.

Figure 2:
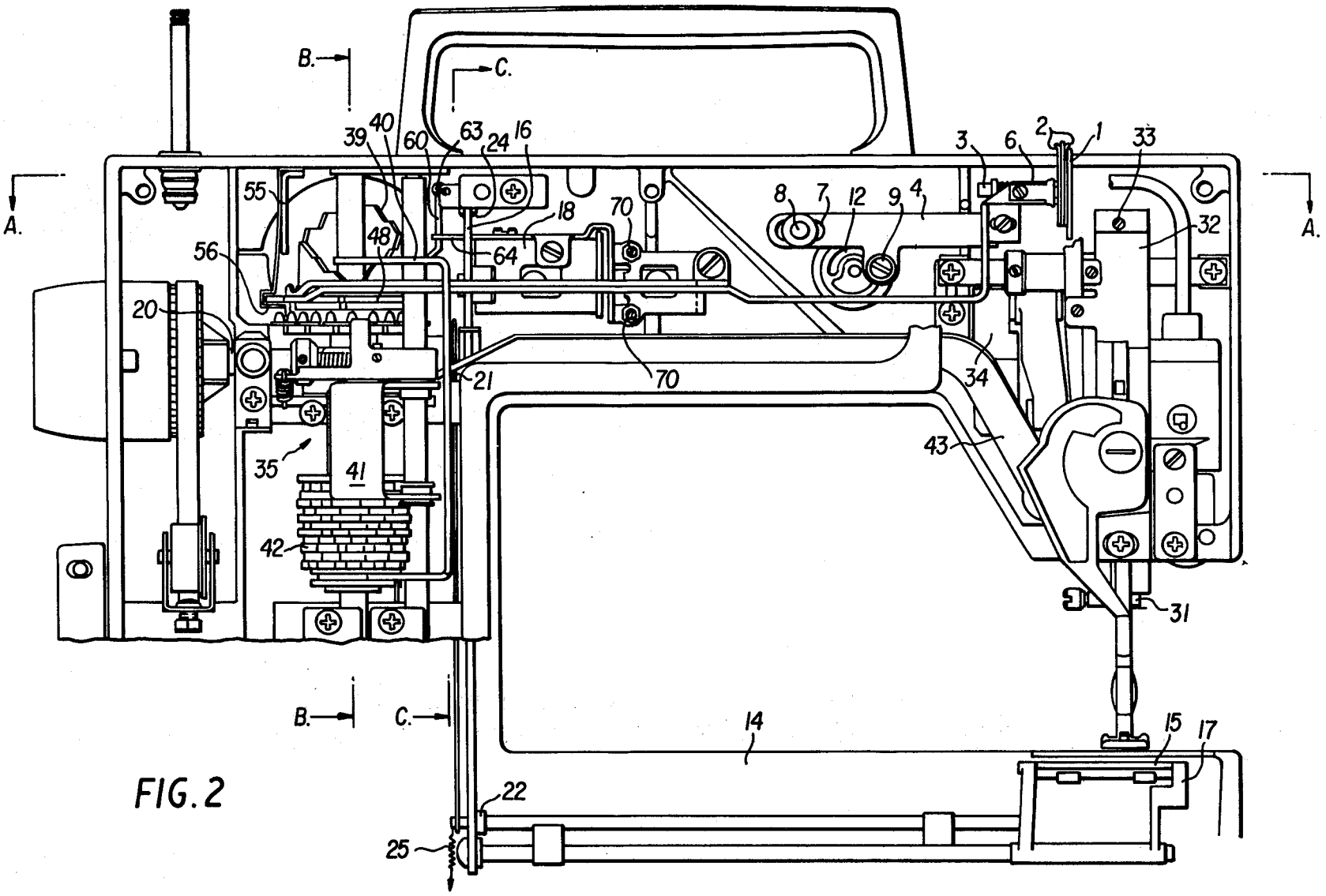
FIG. 2 is a vertical projection of the rear side of the machine with a wall removed.

The needle bar 31 of a zig-zag sewing machine of the type intended here is journalled in a swing arm 32 having a pivot axis 33. The needle bar is operated in a conventional manner by a crank 34 at the end of the over-arm spindle 20. The swing-arm of the needle-bar is biassed on one side by a spring which sets the bar in its left starting position shown in FIG. 2. The needle bar is guided from this starting position in zig-zag movements in a varying pattern by means of the zig-zag guide 35 of the machine, in which guide a cam-plate set, cam followers and transmission links are incorporated in the normal manner.

A zig-zag seam is set by rotating a knob 36 on the front side of the machine, this rotary movement being transmitted by means of gears 37, 38 to an axial cam plate 39 which sets the cam set link 40 to different positions. In the particular position corresponding to the set seam pattern, a cam follower 41 will be on the same level as the corresponding cam plate in the set of cam plates 42, which cam plate guides the needle bar laterally via a link 43.

To enable fancy seams to be selected automatically, in accordance with the present invention, the aforedescribed machine comprises a series of elements and functions, which elements and functions will now be described. By way of examples of symbols used for sewing a fancy seam by means of the elements incorporated by the invention, the scale around the knob 36 has been given three patterns 44, 45, 46 of button holes. Setting of the knob to these symbols represents different phases of a button hole seam, the tension of the thread and the length of stitch being unchanged during the sewing operation. As mentioned in the introduction, the thread tension and stitch length are set independently of the existing position of the knobs 10 and 26. This means that the pressure exerted by the spring 5 on the plate 2 and the setting force exerted by the lever arm 28 on the cullis 18 at the beginning of said sewing operation must be eliminated, and the values of thread tensioning force and setting force on the cullis must be set for the seam to be sewn. For this purpose the angle plate 6 and lever arm 28 constitute coupling and uncoupling means.

Figure 3:
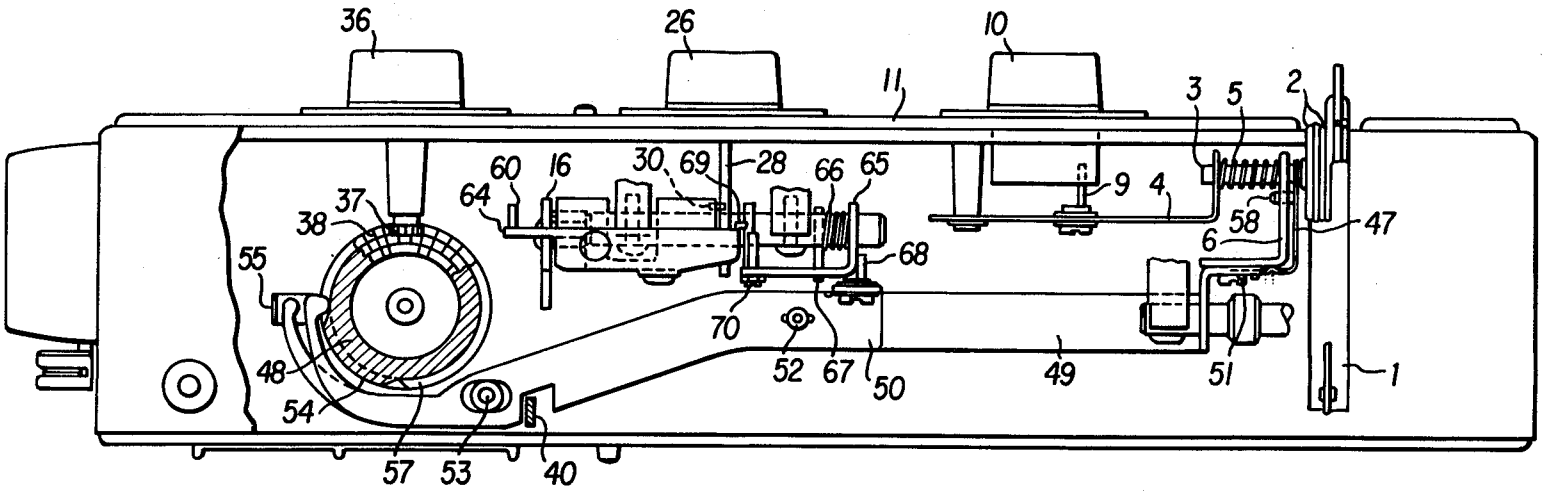
FIG. 3 is a horizontal sectional view taken through the line A—A in FIG. 2.
Figure 5:
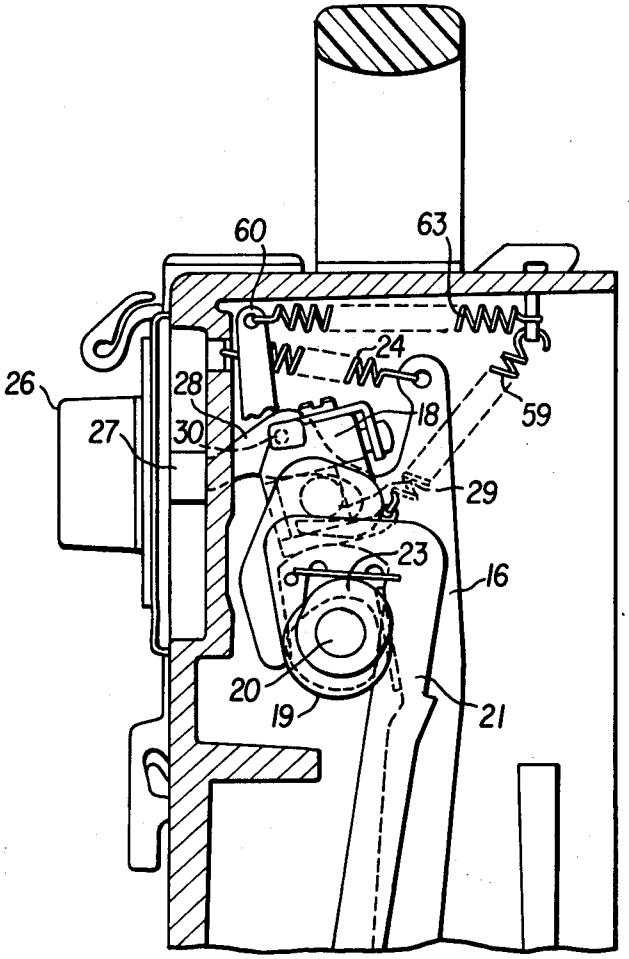
FIG. 5 is a vertical sectional view taken through the line C—C in FIG. 2.

The pressure exerted on the plates 2 by the springs 5 is removed by moving the angled plate 6, FIG. 3, to the left against the pressure of spring 5, whereupon an angle-plate spring 47 mounted on the angled plate 6 is released from its position clamped between the angled plate and the plates 2 and causes a thread-tensioning force to be exerted on the plates. This leftward movement of the angled plate takes place when a cam plate 48 (FIGS. 2 and 3) on the axial cam plate 49, during rotation thereof, urges two links 49, 50, of which the first has an attachment 51 for the angle plate, to the left. The links are mounted on guide pins 52, 53 and have elongate holes which permit the links to be displaced in the longitudinal direction. Normally the links are free vis-a-vis each other, although when the right hand region 54 of the cam plate 48 acts on the end of link 50, this passes to the end of the link 49, whereupon said link is also moved to the left.

If the manual setting of the knob 10 has been such that the spring 5 exerts a smaller force on the plate than the spring 47 will exert, an additional spring force must be included, this force being obtained from a leaf spring 55 having a free end 56 which is extended over the ends of the links and rests against a cam 57, which cam also rotates together with the axial cam plate 39. As will be seen from FIG. 3, the end of spring 55 lies in a lower region of the cam plate 57, at the same time as the ends of the links are lifted out of the cam plate 48. The links are therewith held in a stable position, which provides the spring 47 with a fixed starting point from which it can exert its spring force against the plate 2. When the knob 36 is rotated beyond the symbols 44–46, the region 54 has passed the link ends, so that the links are free. Further, the spring 47 has a limited active length, owing to the fact that a hook 58 thereon engages around the angle plate and a certain extension of the spring will cause the same to abut said angle plate. In this way there is obtained a still smaller thread-tensioning force against the plates 2 than that exerted by the spring 47, while the spring 5 can be set by means of the knob 10.

The manual setting of the cullis 18 is cancelled and the shortest stitch length of which the machine is capable is set when the knob 36 is set to the symbols 44–46. The cullis is acted upon by a spring 59 which attempts to set the cullis to the largest possible stitch length; although not longer than that permitted by the lever arm 28 and the knob 26. The cullis can also be set to a shorter stitch length than that set on the knob by rotating the cullis against the action of spring 59. This possibility is utilized when automatically setting the stitch length, as mentioned in the introduction.

Figure 4:
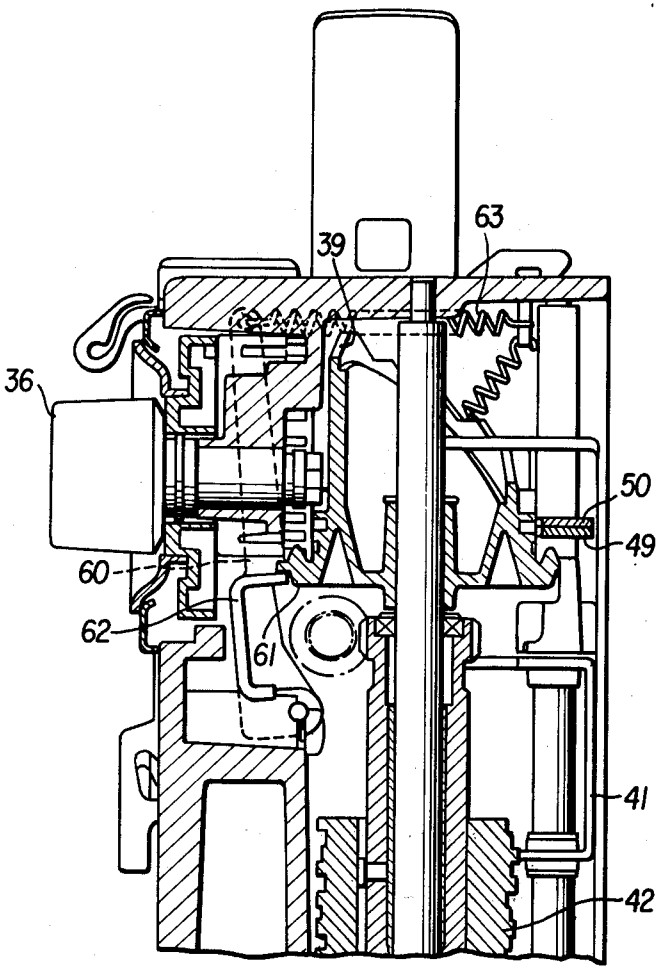
FIG. 4 is a vertical sectional view taken through the line B—B in FIG. 2.

As will be seen from FIG. 4, a lever arm 60 is journalled beneath a cam plate 61, which rotates together with the axial cam plate 39 and acts upon the lever arm against the action of a spring 63 by means of a cam follower 62. When the cam follower enters the lowest region of the cam plates, which occurs when the knob 36 is set to the symbols 44–46, the spring 63 pulls the arm 60 clockwise in FIG. 4. This movement is transmitted to the cullis via a finger 64 against which the arm 60 lies, whereupon the cullis (FIG. 3) is rotated against the action of the spring 59.

The pivot axis 29 of the cullis is extended to the right in FIG. 3 and carries a stirrup 65 which is axially displaceable on the shaft against the action of the spring 66, which spring biasses the stirrup to the right in the Figure. A guide pin 67 passes through the shaft and an elongate hole in the stirrup, and prevents the stirrup from swinging on the shaft. The aforementioned link 50 has a screw pin 68 in the proximity of the stirrup and when the link is moved to the left, the stirrup is moved by said pin towards the cullis. During this movement, which takes place simultaneously with the aforedescribed rotation of the cullis, the stirrup and the cullis are coupled together by means of hooks 29 on said cullis and setting screws 70 on the stirrup. The position of the cullis is thereby fixed and set to a value which provides the length of stitch intended for the seam pattern in question. The object of the spring 66 is to re-set the stirrup to the starting position, i.e. to uncouple the same from the cullis subsequent to the knob 36 having been rotated beyond the symbols 44–46. The stitch length is then again set to the value shown by the knob 26.

The aforedescribed embodiment of the sewing machine is an example of how the invention can be put into effect. It will be readily understood that several of the functions or positions can be carried out or set with different devices, for example one of the setting screws 70 may have a position which permits back-feeding and the other a position for forward-feeding of the cloth. The features associated with the invention are defined in the claims.

What I claim is:

1. A zig-zag sewing machine having a plurality of rotary selectively connectable cam plates with cam followers for guiding a laterally moveable needle bar to produce fancy seams, seam selecting means for activating one of the cam plates, setting means for regulating forward feed and feed direction of the cloth, means for regulating over-thread tension, and pattern selecting means including a setting region in which, in addition to the selection of a pattern, controls for the cloth feed and over-thread tension are arranged to be activated and set to predetermined values by movement transmitting means for transmitting movement from the pattern selecting means directly to an adjustable cullis and thread brake respectively, irrespective of the setting positions of respective setting means for said cullis and brake, said movement transmission means comprising cam plates and cam followers with associated links, and coupling and uncoupling means which are maneuverable by said links to cancel settings set by the setting means for the cullis and thread brake respectively.

2. A sewing machine according to claim 1, characterized in that the pattern selecting means are arranged such that movement of said selecting means beyond said setting region allows the cullis and the thred brake to reset to values determined by their respective setting means.

3. A sewing machine according to claim 1, characterized in that said setting region relates to button hole seams, and in that the pattern selecting means and the movement transmission means are arranged to co-act so that the left starting position and right starting position for a zig-zag seam corresponds to a feed of the same magnitude but in opposite directions when the stitch breadth is approximately half the maximum.

4. A sewing machine according to claim 1, characterized in that said transmission means comprises at least one extra cam plate and cam follower and associated link which is arranged to be activated in said setting region to transfer setting movements to the cullis.

5. A sewing machine according to claim 4, characterized in that predetermined values of the cullis setting are adjustable by means of screws.

6. A sewing machine according to claim 5, characterized in that said predetermined values can be set for both forward feed and back feed.

* * * * *